US006595744B2

(12) United States Patent
Van Houten

(10) Patent No.: US 6,595,744 B2
(45) Date of Patent: Jul. 22, 2003

(54) AUTOMOTIVE FAN ASSEMBLY WITH FLARED SHROUD AND FAN WITH CONFORMING BLADE TIPS

(75) Inventor: Robert Van Houten, Winchester, MA (US)

(73) Assignee: Robert Bosch Corporation, Waltham, MA (US)

( * ) Notice: Subject to any disclaimer, the term of this patent is extended or adjusted under 35 U.S.C. 154(b) by 0 days.

(21) Appl. No.: 09/883,730

(22) Filed: Jun. 18, 2001

(65) Prior Publication Data

US 2002/0076327 A1 Jun. 20, 2002

Related U.S. Application Data

(60) Provisional application No. 60/211,988, filed on Jun. 16, 2000.

(51) Int. Cl.[7] ..... F04D 29/38

(52) U.S. Cl. ..... 415/173.1; 415/208.1; 415/211.1; 415/222; 416/189; 416/223 R; 416/228; 416/238; 416/DIG. 2; 416/DIG. 5; 123/41.99

(58) Field of Search ..... 416/169 A, 189, 416/192, 223 R, 228, 238, DIG. 2, DIG. 5; 123/41.99; 415/173.1, 173.5, 220, 208.1, 211.1, 222

(56) References Cited

U.S. PATENT DOCUMENTS

| | | | |
|---|---|---|---|
| 4,548,548 | A | 10/1985 | Gray, III |
| 4,569,631 | A | 2/1986 | Gray, III |
| 4,657,483 | A | 4/1987 | Bede |
| 4,871,298 | A | 10/1989 | Vera |
| 5,215,438 | A | 6/1993 | Chou et al. |
| 5,249,927 | A | 10/1993 | Vera |
| 5,297,931 | A | 3/1994 | Yapp et al. |
| 5,520,513 | A | 5/1996 | Kuroki et al. |

FOREIGN PATENT DOCUMENTS

| | | |
|---|---|---|
| FR | 1178215 | 12/1958 |
| JP | 3-11114 | 9/1989 |

*Primary Examiner*—Christopher Verdier
(74) *Attorney, Agent, or Firm*—Fish & Richardson P.C.

(57) ABSTRACT

High efficiency and low noise is achieved in an automotive engine-cooling fan assembly by flaring the inlet to the shroud barrel, and shaping the tips of the fan blades to conform to the shape of the inlet. Separation of the flow entering the fan is reduced by extending the flare over the axial extent of the blade tip, and tip clearance losses are reduced by controlling recirculation along the entire blade tip. Blade rake is used to minimize fan deflection, thereby allowing the use of small tip clearances, which further enhance performance.

14 Claims, 12 Drawing Sheets

FIG. 2a
PRIOR ART
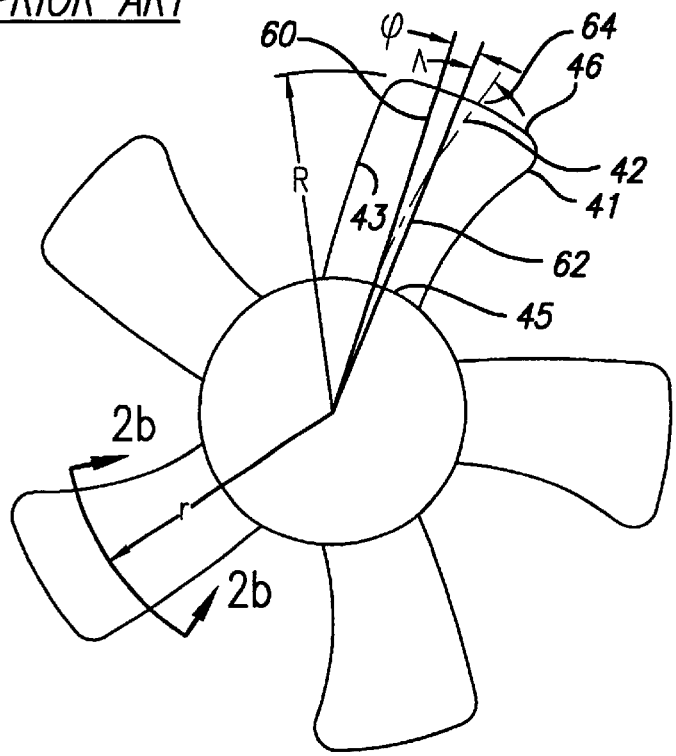
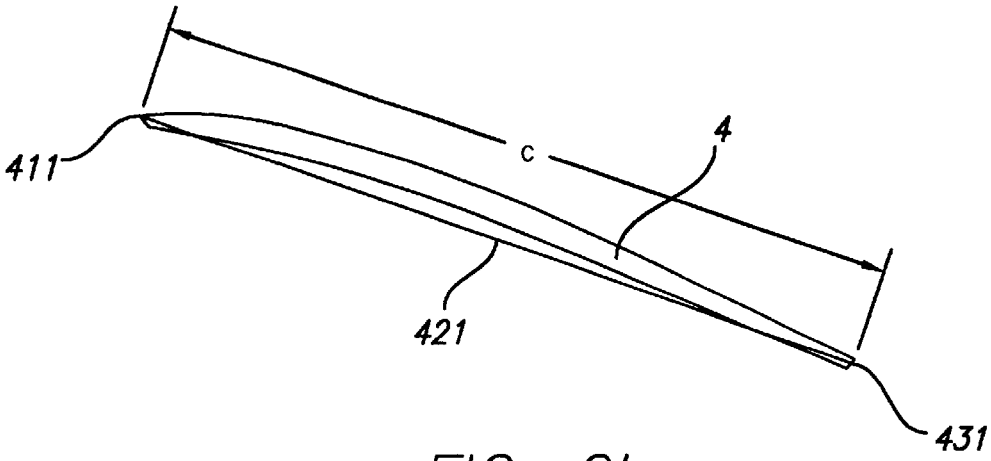
FIG. 2b

AUTOMOTIVE FAN ASSEMBLY WITH FLARED SHROUD AND FAN WITH CONFORMING BLADE TIPS

RELATED APPLICATIONS

This application claims priority to U.S. provisional application No. 60/211,988, filed on Jun. 16, 2000, the contents of which are incorporated herein by reference.

BACKGROUND

The engine in an automotive vehicle is typically cooled by liquid coolant which is pumped through a liquid-to-air heat exchanger, or radiator. Due to the difference in density between coolant and air, the radiator is typically relatively narrow in width, but has a large face area through which the cooling air passes. Other vehicular heat exchangers, such as a condenser for the air-conditioning system, have similar configuration and are often cooled in series with the radiator.

The location of these heat exchangers is typically the front of the vehicle, behind openings in the vehicle body, so high pressure due to forward motion of the vehicle can cause air to move through them. However, in order to assure that sufficient air moves through the heat exchangers when the cooling requirements are severe, or when the vehicle is not moving, a fan assembly is fitted either upstream or downstream of the heat exchangers.

The fan assembly typically includes a fan and a shroud which surrounds the fan and guides air between the heat exchanger and the fan. The fan is typically driven by an electric motor supported by a bracket which is attached to, or integral with, the shroud. Due to under-hood space constraints, the shroud must in general be of minimum depth while at the same time covering a large area of heat exchanger surface. Because of this, much of the cooling air approaches the fan from essentially the (negative) radial direction, and must turn almost 90 degrees if it is to flow through the tip region of the fan.

If it fails to turn sufficiently, it will separate from the shroud surface, and compromise the efficiency and acoustic performance of the fan.

Another constraint on the fan design is that its noise be acceptable to the customer. Fan noise includes both broadband noise and tones, the latter being generated by the fan's interacting with a non-axisymmetric inflow. One way of minimizing these tones is to incorporate skew in the blade design. Skewed blades can, however, have structural problems which radial blades do not encounter.

There are many other constraints on the design of the fan assembly. One requirement is that the fan and shroud be inexpensive to manufacture. For this reason it is typically a plastic injection-molded part. Clearances between the fan and shroud must accommodate manufacturing tolerances as well as deflections of the parts in service. These deflections include long-term creep, and depend on time, temperature, and humidity. Fan deflections arise from centrifugal and aerodynamic forces and include components in both the radial and the axial directions. The fan assembly must be designed in such a way that the fan does not contact the shroud at any time, and yet have a sufficiently small clearance gap that leakage between the fan and the shroud does not overly compromise efficiency or noise. Two types of fans have been used for this application, differing in the nature of the clearance gap through which leakage occurs.

One type of fan is a free-tipped fan, where the clearance gap is between the shroud and the ends of the rotating blades. This type of fan typically has blades which are almost radial in configuration, with only a small amount of skew. Typically the blades have a constant-radius tip shape, so that only a radial deflection, which is minimized by their almost-radial configuration, can cause contact with the shroud. FIG. 1*a* shows a typical free-tipped engine-cooling fan.

The second type of fan is a banded fan, the blade tips of which are attached to a rotating band. The clearance gap through which recirculation takes place is between the rotating band and the shroud. One advantage of this configuration is that the leakage flow can be minimized by use of various leakage control devices (U.S. Pat. No. 5,489,186). Another advantage is that the band can provide structural support for skewed blades (U.S. Pat. Nos. 4,569,631, 4,569,632), minimizing their deflection.

Both of these fan types have disadvantages.

The efficiency of free-tipped fans depends strongly on the tip gap. Air moves around the blade tip from the pressure side to the suction side, thereby reducing the pressure difference across the blade in the tip region and generating a concentrated tip vortex. This vortex is a loss mechanism, and can be a source of noise. A configuration such as that shown in FIG. 1*b* minimizes the tip gap, but at the expense of flow separation due to the small inlet radius on the shroud barrel. FIG. 1*c* shows a more typical free-tip fan assembly, where separation is minimized by allowing the forward portion of the blade tip to extend into the fan plenum and employing a more generous inlet radius. This configuration, however, has higher tip leakage losses, since small tip gaps are maintained only at the rearward portion of the blade tips. Free-tipped fans tend to be noisier than banded fans, particularly at more resistive operating points. Stall tends to be more extreme and more sudden for these fans.

Although banded fans have reduced tip clearance losses relative to free-tipped fans, they have the additional viscous losses of the rotating band. These losses are particularly severe at lightly-loaded operating points, where the fan speed is relatively high for the pressure and flow developed. Such operating points are common in automotive applications, since they allow the use of inexpensive low-torque motors. Another source of parasitic loss for a banded fan is flow separation at the band. Due to molding requirements, the inner surface of the band must be essentially cylindrical over the axial extent of the blades, as shown in FIG. 1*d*. A lip is usually added to the front of the band, but it is of necessity of limited extent, due to the tight space requirements. Flow separation is often the result. The rotating band also leads to some noise and vibration problems. Any axial run-out of the band causes a large couple imbalance which can lead to vibration problems in the vehicle. Also, the large moment of inertia of a banded fan prolongs the time during which the fan coasts down when the fan is de-powered. The coast-down process can lead to objectionable noise in the vehicle. In addition to these performance issues, banded fans can be more expensive to manufacture than free-tipped fans. The mass of the band at a large radius makes a banded fan more likely to require a separate balancing operation than a free-tipped fan. A banded fan requires the use of more material than would be required for a free-tipped fan, and the presence of knit lines in the band requires the use of more expensive material than might otherwise be used.

OBJECTS OF THE INVENTION

One object of the invention is to maximize the efficiency of an automotive engine-cooling fan assembly by minimizing leakage between the fan and the shroud.

Another object is to maximize the efficiency of the fan assembly by minimizing flow separation.

Another object is to minimize the noise generated by the fan.

Another object of the invention is to provide a low-cost assembly by minimizing the amount and cost of the plastic material used in its manufacture.

Another object is to minimize the static and couple imbalance of the fan, and thereby reduce the cost of balancing the fan and the amount of vibration in the vehicle.

Another object is to minimize the moment of inertial of the fan in order to shorten the coast-down process when the fan is de-powered.

SUMMARY

The present invention is an un-banded automotive engine-cooling fan and shroud assembly. The shroud has a barrel with a flared inlet and at least a portion of each blade tip conforms to the shape of this inlet. The radius of the blade tip is larger at the upstream end of the conforming portion than at the downstream end of this portion.

In a preferred embodiment, the entire blade tip conforms to the shape of the shroud inlet. Also in a preferred embodiment, the clearance gap between the blade tip and the shroud is approximately constant. Because the tip gap is maintained at its minimum value over substantially the entire blade tip, tip clearance losses and fan noise are minimized. In addition, the large inlet flare allowed by this design minimizes flow separation. This also maximizes fan efficiency and minimizes noise.

In one particular embodiment, the blade tip extends upstream of the portion of the blade tip which conforms to the shroud flare. In this embodiment, the axial extent of this upstream portion is less than approximately 0.3 times the axial extent of the blade tip.

The shroud barrel downstream of the flared inlet may be approximately cylindrical. In one embodiment the blade tip extends downstream of the downstream end of the shroud flare. In this embodiment, the axial extent of this downstream portion is less than approximately 0.5 times the axial extent of the blade tip.

In the preferred embodiment, the radius of the shroud barrel at the axial position of the blade trailing edge does not exceed the minimum radius of the shroud barrel by more than 0.02 times the fan diameter. References to shroud radii refer to the radius of the air passage inside the shroud.

In one embodiment, the shroud barrel may step inward downstream of the trailing edge of the blade tip.

In yet another embodiment, the shroud barrel is relatively short, in that the distance between the termination of the shroud barrel and the trailing edge of the blade tip is less than approximately 0.5 times the axial extent of the blade tip. In a preferred embodiment, this distance is less than approximately 0.3 times the axial extent of the blade tip.

The invention also features blade geometry that minimizes deflection at the blade tip. In one embodiment the fan is radial-bladed, and the tips are raked forward by less than 3 percent of the fan diameter. In a preferred embodiment, the fan is skewed. Preferably, the fan has a forward rake angle in regions where it is either forward-swept or it is back-swept less than approximately 5 degrees, and it has a rearward rake angle where it is back-swept by more than approximately 15 degrees.

In a preferred embodiment, the fan is swept forward near the hub and backward near the blade tips, and has forward rake angle near the hub and rearward rake angle near the tips In another embodiment, the fan is swept backward near the hub and forward near the blade tips, and has rearward rake angle near the hub and forward rake angle near the blade tips.

In a preferred embodiment, the flare shape is approximately elliptical, the distance between every point on the surface of the flared inlet and a corresponding point on an approximating ellipse being less than 0.5 percent of the fan diameter. In a preferred embodiment the approximating ellipse is oriented so as to have axial and radial semi-axes, and has an axial semi-axis approximately 0.5 to 2.0 times the axial extent of the blade tip, and a radial semi-axis approximately 0.4 to 1.0 times the axial semi-axis. In the preferred embodiment the axial semi-axis is between 0.04 and 0.14 times the fan diameter, and the radial semi-axis is between 0.02 and 0.11 times the fan diameter.

In a preferred embodiment, the radius of the upstream end of the conforming portion of the blade tip is between approximately 2% and 15% greater than the radius of the downstream end of the conforming portion of the blade tip.

In a preferred embodiment, the minimum clearance between the blade tip and the shroud is between 0.007 and 0.02 times the fan diameter. The axial distance measured at a constant radius between the blade leading edge and the shroud is between approximately 0.011 and 0.034 times the fan diameter.

In the preferred embodiment, the distance between each point on a curve in the meridional plane swept by the conforming portion of the blade tip and a corresponding point on an approximating ellipse is less than 0.5 percent of the fan diameter. In the most preferred embodiment the ellipses approximating the shapes of the flared inlet and the blade tip are oriented so as to have axial and radial semi-axes, and the difference between the axial semi-axes of the two ellipses is equal to or greater than the difference between the radial semi-axes.

In the preferred embodiment, the leading edge of the fan tip is no more than 0.04 fan diameters downstream of the upstream edge of the shroud flare.

In the preferred embodiment the blade chord at the tip is approximately 0.2 to 0.4 times the fan diameter.

In one embodiment the fan assembly is mounted downstream of a heat exchanger. In the preferred embodiment, the shroud incorporates a plenum, which covers an area of the heat exchanger face, which is at least 1.5 times the disk area of the fan. This embodiment benefits particularly from the large inlet flare, which is a feature of this invention. The flow from the plenum region has a large radial component as it approaches the fan barrel, and separation is likely in the absence of such a flare.

In another embodiment, the fan assembly is mounted upstream of a heat exchanger.

In the preferred embodiment, the fan and the shroud are made of injection-molded plastic. In the most preferred embodiment the shroud is molded as a single part.

DETAILED DESCRIPTION

Figure 1A:
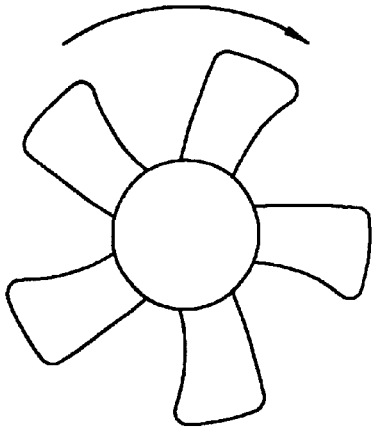
FIG. 1a PRIOR ART
FIGS. 1*a,* 1*b,* and 1*c* are sketches of a prior-art free-tipped fan and two alternative shroud configurations.

FIG. 2*a* is a sketch of a prior-art fan blade showing the various blade parameters. The fan 10 is a left-hand fan, rotating in a clockwise direction when viewed from the upstream side. The leading edge 41 of blade 4 rotates in advance of the mid-chord line 42 and the trailing edge 43. The skew angle $\phi$ at radius "r" is the angle between the radial line 60 through the mid-chord point at the blade root 45 and the radial line 62 through the mid chord line of the section at radius "r". The mid-chord sweep angle $\theta$ at radius "r" is defined as the angle between the radial line 62 and the local tangent to the mid-chord line 64. The fan shown is forward-swept—that is, the blades are swept in the direction of rotation.

Figure 2C:
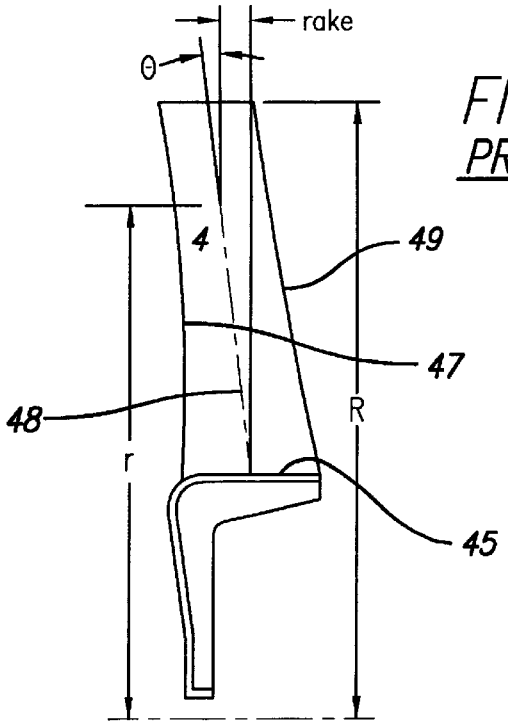
FIG. 2c PRIOR ART
FIGS. 2*a,* 2*b,* and 2*c* are sketches of a prior-art fan blade defining various blade parameters.

FIG. 2*c* is a section through the fan hub and a "swept" view of the fan blade 4. Line 47 represents the axial position of the blade leading edge as a function of radial position. Similarly, line 48 and line 49 represent the axial positions of the blade mid-chord and blade trailing edge as a function of radial position. The rake at radius "r" is defined as the axial distance between the mid-chord line 48 at radius "r" and the mid-chord line 48 at the blade root. The rake angle $\theta$ at radius "r" is the angle line 48 makes at that radius with a plane normal to the rotation axis.

Figure 3A:
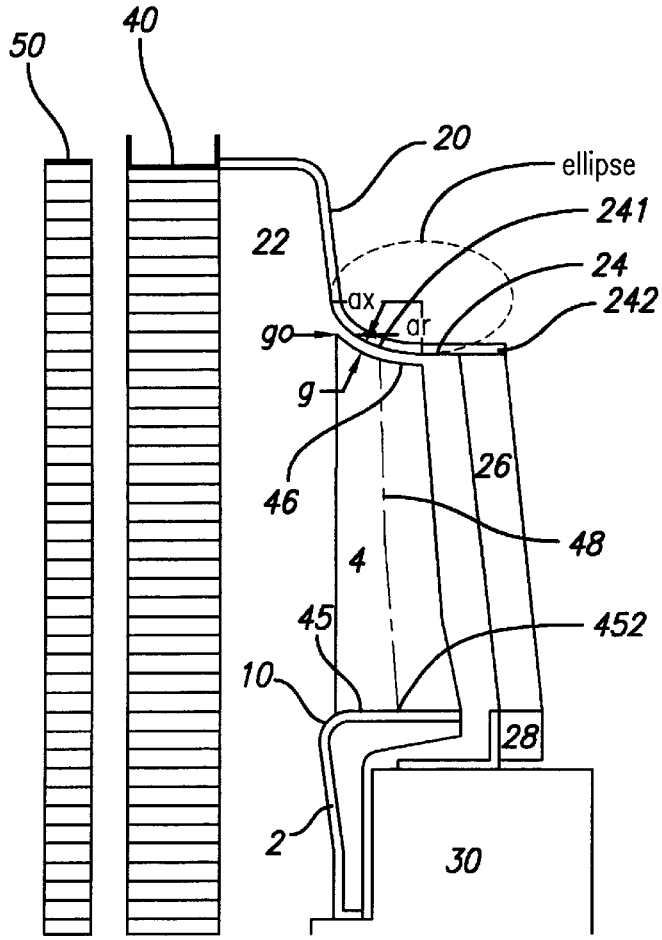
FIGS. 3*a,* 3*b,* 3*c* and 3*d* are sketches of a fan assembly in accordance with the present invention where the shroud is mounted downstream of the heat exchangers and the fan is radial-bladed.

FIG. 3*a* shows a section through an automotive radiator and condenser, and a shroud and radial-bladed fan according to the present invention. A condenser 50 is mounted in front of radiator 40, to which a shroud 20 is attached. Shroud 20 forms a plenum 22 and a barrel 24. Barrel 24 comprises a flared inlet portion 241 and a cylindrical portion 242. Multiple stators 26 extend inward from barrel 24 and support a motor-mount 28. An electric motor 30, attached to motor-mount 28, drives a fan 10. The fan comprises a hub 2, and multiple blades 4, shown in a "swept" view. The tips 46 of the fan blades 4 are shaped to conform to the shape of the barrel.

Figure 1B:
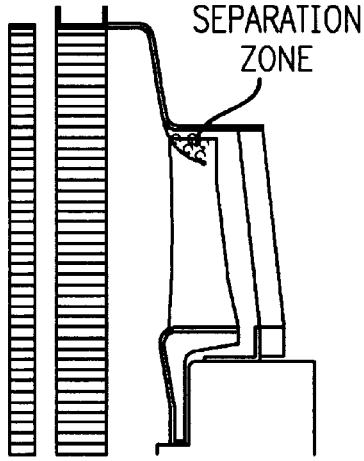
FIG. 1b PRIOR ART
FIG. 1*d* is a sketch of a prior-art banded fan and shroud.
Figure 1C:
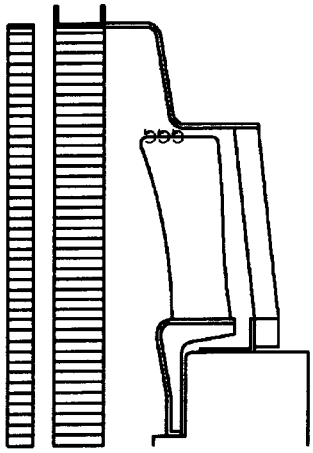
FIG. 1c PRIOR ART
Figure 1D:
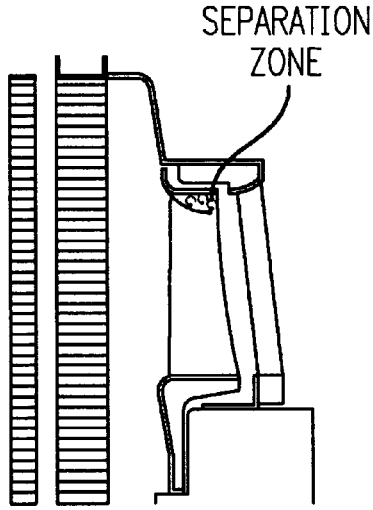
FIG. 1d PRIOR ART

The advantage of the configuration shown in FIG. 3*a* is that a small tip gap is maintained over the entire extent of the blade tip, while at the same time the flow is allowed to contract gradually, in a way that minimizes the tendency of the flow to separate from the shroud surface. This situation can be favorably compared to that shown in FIG. 1*b,* where a small tip gap is maintained, but at the expense of a very small inlet ellipse, which tends to cause separation, inefficiency, and noise. The arrangement shown in FIG. 3*a* can also be favorably compared to that shown in FIG. 1*c,* where a large inlet ellipse is obtained at the expense of a large tip gap, which also causes inefficiency and noise.

The geometry of the flared inlet shown in FIG. 3*a* approximates a quarter of an ellipse, with semi-axes ar and ax. Equally good performance, however, can be obtained with inlet shapes which only approximate an ellipse, a good approximation being one where the geometry varies from an ellipse by plus or minus half a percent of the fan diameter. The mid-chord line 48 of FIG. 3*a* shows a small amount of forward rake, which minimizes deflection of a radial-bladed fan under centrifugal loading. Otherwise, axial deflection due to both centrifugal and aerodynamic loading will tend to increase the clearance gap in service. Too much rake, however, will result in downstream axial deflection, which can result in contact between the fan and the shroud.

Although optimization of blade geometry can minimize fan deflections under load, they can never be eliminated. Anticipated deflections and several other factors determine the required clearance gap between the blade tips and the shroud. The required clearance in the axial direction ga is often greater than that in the radial direction gr.

Figure 3B:
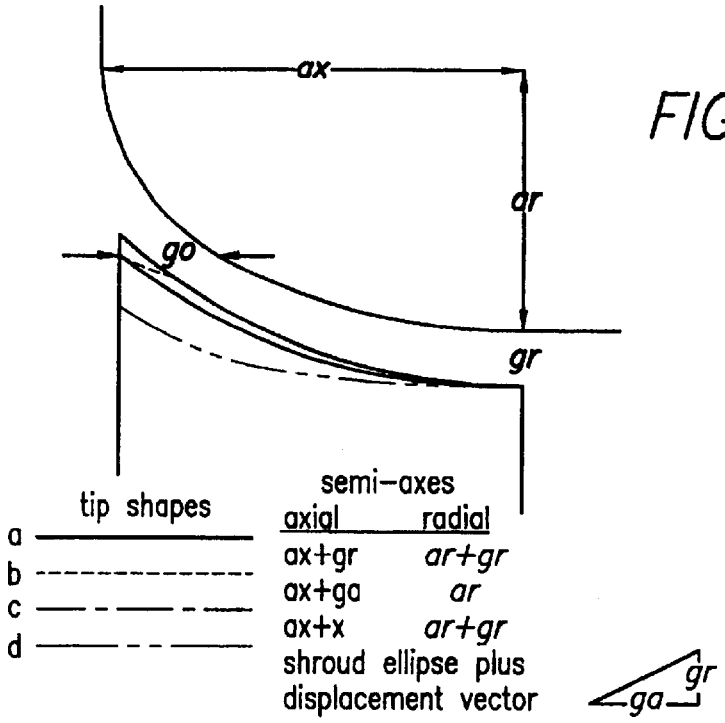

In the embodiment shown in FIG. 3*a,* the tips 46 of the fan blades 4 are shaped to maintain an approximately constant clearance g with respect to the shroud barrel inlet 241, where g is measured perpendicularly to the shroud surface. The shape of the blade tip corresponds to tip shape "a" in FIG. 3*b.* With this tip shape, the axial clearance between the blade tip and the shroud can be seen to be a minimum at the blade leading edge. If this minimum clearance is less than the required clearance ga, this tip shape will be unsatisfactory. Tip shape "b" represents a line of constant axial gap, ga, where it is assumed that ga is twice as large as gr. An acceptable tip shape would follow tip shape "a" for the rearward portion of the blade tip, and tip shape "b" for the forward portion. A more conservative approach would be to use tip shape "c", which is a single ellipse which satisfies the minimum required axial and radial gaps. The most conservative tip shape is "d", where the blade can simultaneously move axially a distance ga and radially a distance gr before touching the shroud. This last approach could be modified to reflect predicted deflection as a function of position along the blade tip.

Figure 3C:
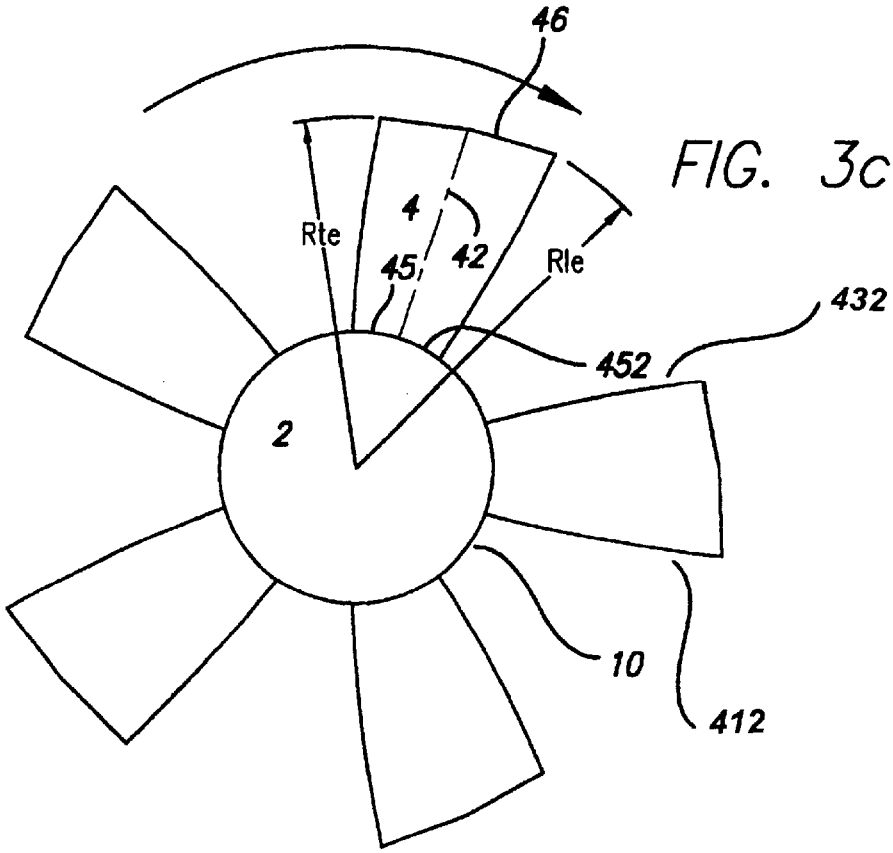

FIG. 3*c* shows an upstream view of the fan of FIG. 3*a,* showing the radial nature of the blades. The blade tip 46 does not lie on a constant-radius line, but instead the leading edge of the blade tip 412 lies at a radius Rle which is larger than the radius Rte of the trailing edge of the blade tip 432. The tip chord length ctip can be defined as the chord length of the blade at the radius of the tip trailing edge, Rte, and the fan diameter D can be taken to be equal to twice that radius. The fan disk area can be taken to be the area of a circle of diameter D.

Figure 3D:
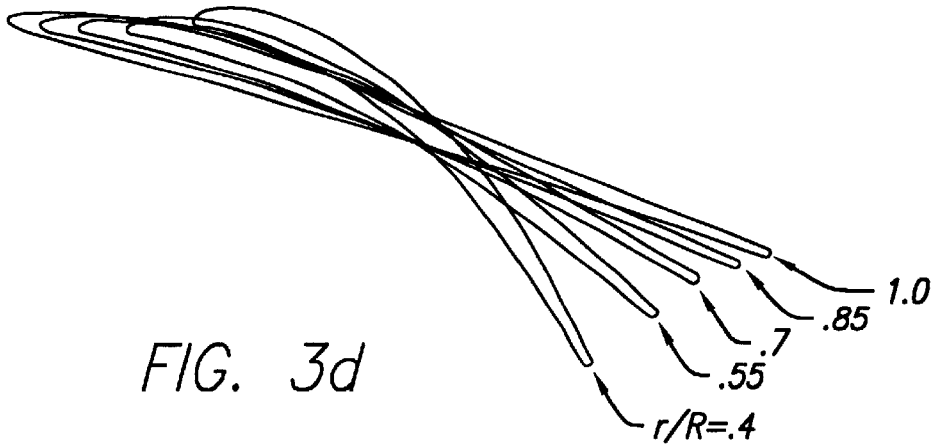

FIG. 3*d* shows several cylindrical blade sections of the fan of FIGS. 3*a* and 3*c,* the viewpoint being taken along the ray which passes through the mid-chord point 452 of the blade root 45, as shown in those figures.

Figure 4A:
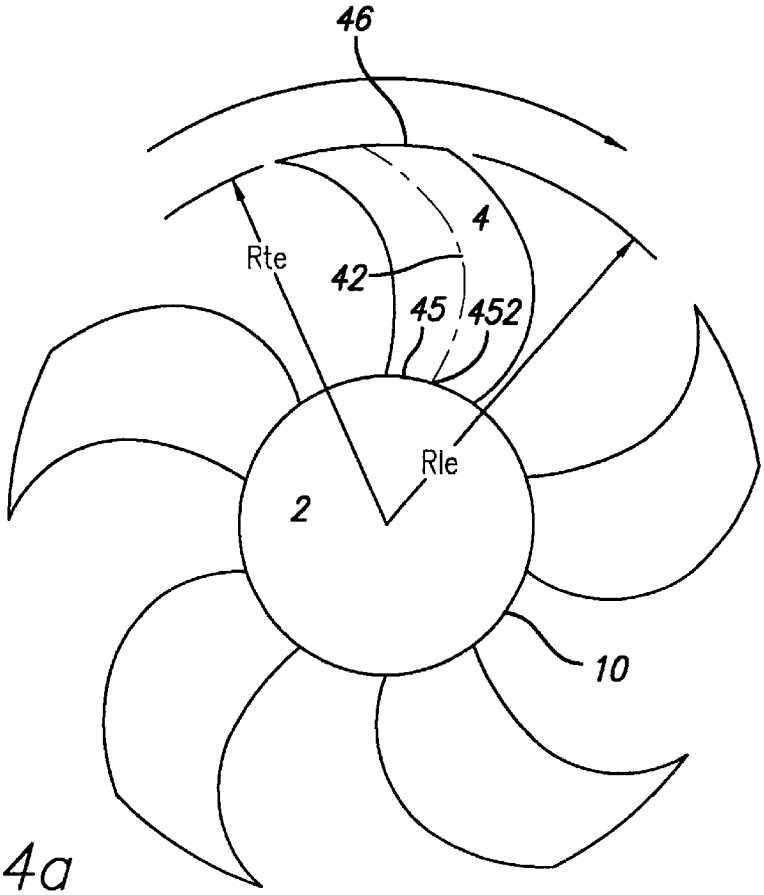
FIGS. 4*a,* 4*b,* and 4*c* are sketches of a fan assembly in accordance with the present invention where the shroud is mounted downstream of the heat exchangers and the fan blades are forward-swept at the root and backward-swept at the tips.

FIG. 4*a* shows an upstream view of a skewed fan according to the present invention. The sweep of the mid-chord line 42 can be seen to be in the direction of rotation (forward sweep) near the blade root 45, but in the opposite direction near the tip 46. The advantages of a skewed blade are 1) a reduction in turbulence ingestion noise due to the fact that the leading edge moves obliquely through the flow, and 2) a reduction in the acoustic tones generated by circumferential flow non-uniformity. As in the case of the radial fan shown in FIG. 3*b,* the radius of the blade tip leading edge Rle exceeds that of the blade tip trailing edge Rte.

Figure 4B:
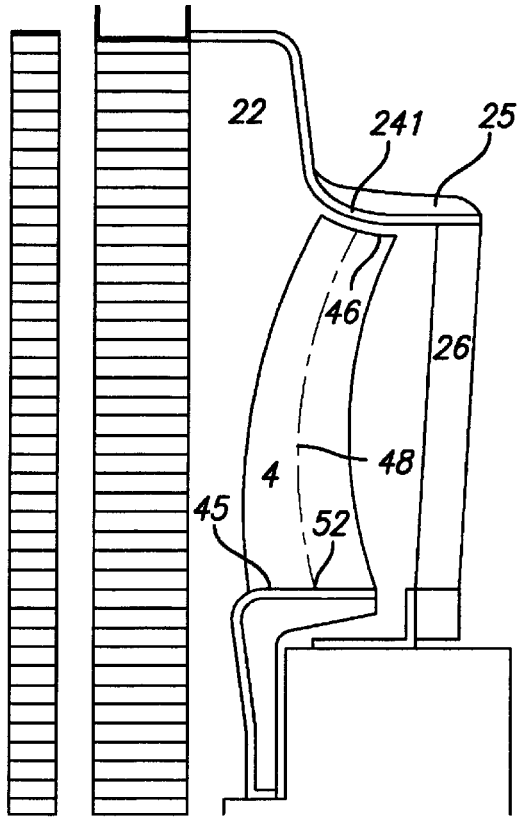

FIG. 4*b* shows a section through a shroud and the skewed fan of FIG. 4*a*. As in the case of the radial-bladed fan shown in FIG. 3*a,* the tips 46 of the fan blades 4 are shaped to maintain an approximately constant clearance with respect to the shroud barrel inlet 241. Also shown are external ribs 25, which are placed at the circumferential locations of the stators 26, to provide greater rigidity, and to aid in maintaining the circular geometry of the shroud barrel.

A potential disadvantage of a skewed blade is that under centrifugal loading it will generally deflect both radially and axially more than will a radial blade. Axial deflection is particularly a problem when the fan and shroud are made in accordance with the present invention, in that forward deflection causes an increase in tip clearance, and rearward deflection can potentially cause contact between the fan and the shroud. However, by raking the blade properly, axial deflection can be minimized, or designed to be slightly forward, since an increase in tip clearance has much less severe consequences than contact with the shroud. The mid-chord line 48 of FIG. 4*b* shows positive (upstream) rake angle in the root region of the blade, and negative (downstream) rake angle in the tip region. This rake distribution "matches" the skew distribution shown in FIG. 4*a,* and minimizes deflections. As an additional benefit, the net effect of this is that the fan is moved forward relative to the position of a radial fan, resulting in a more compact assembly.

Figure 4C:
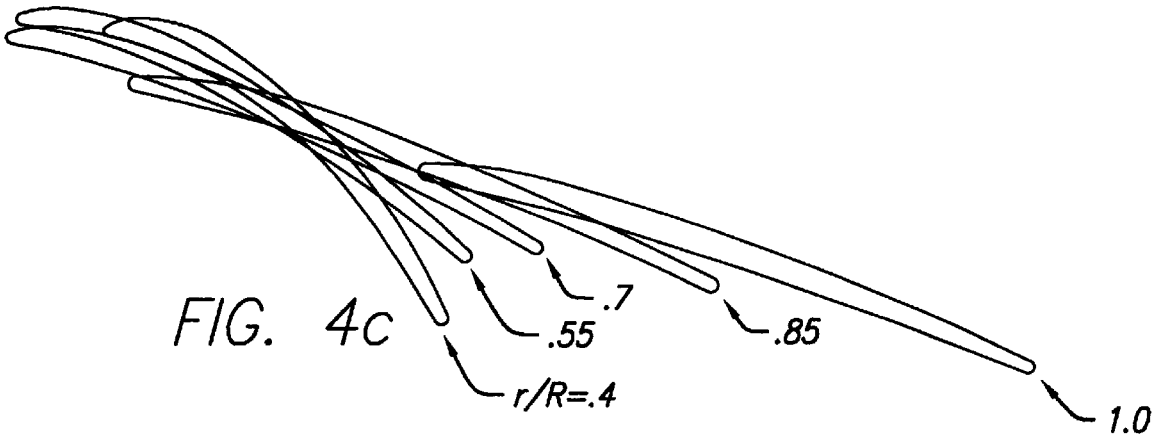

FIG. 4*c* shows several cylindrical sections of the fan shown in FIGS. 4*a* and 4*b,* the viewpoint being taken along the ray which passes through the mid-chord point 452 of the blade root 45, as shown in those figures. The blade sections can be seen to be "stacked" in such a way that the blade is as planar as possible given the twist and camber dictated by performance requirements.

Figure 5A:
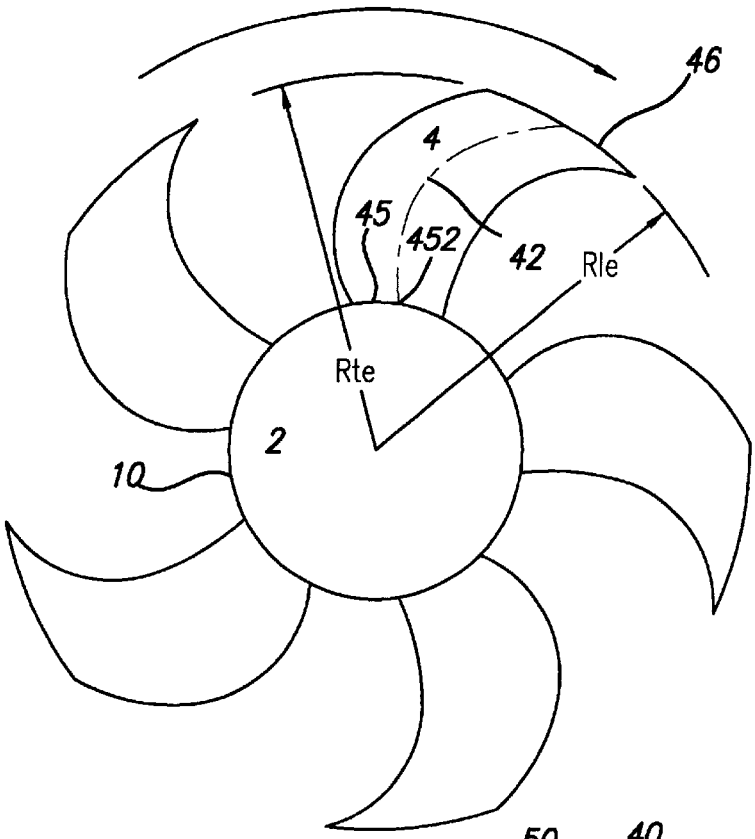
FIGS. 5*a,* 5*b,* and 5*c* are sketches of a fan assembly in accordance with the present invention where the shroud is a ring-shroud mounted downstream of the heat exchangers and the fan blades are backward-swept at the root and forward-swept at the tips.

Other skew distributions are also possible. FIG. 5*a* shows an upstream view of a skewed fan where the sweep can be seen to be in the rearward direction near the root, but in the forward direction near the tip. Forward skew at the tip allows the fan to operate efficiently and quietly at high pressures.

Figure 5B:
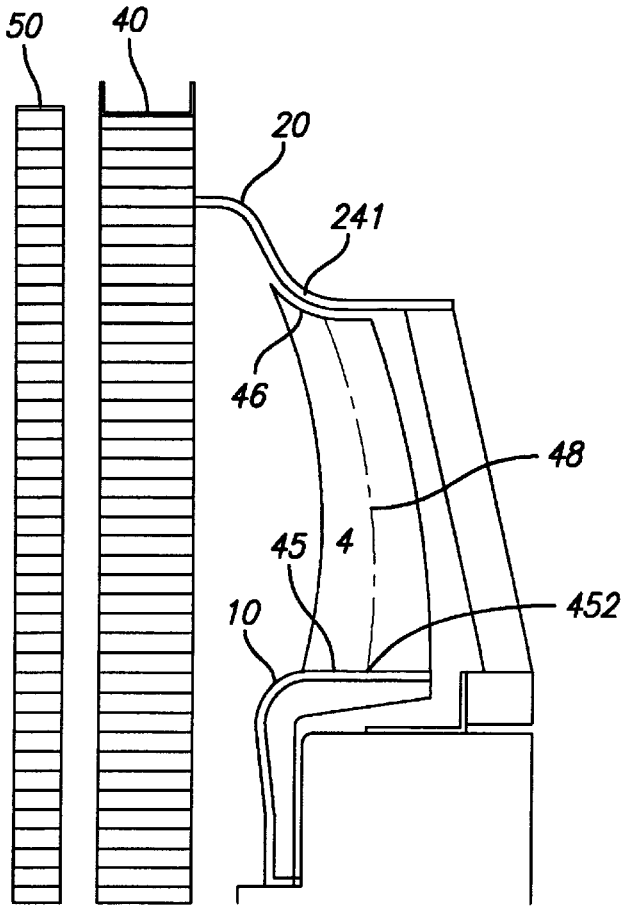

FIG. 5*b* shows a section through a ring-shroud 20 and the skewed fan 10 of FIG. 5*a*. A ring-shroud covers a relatively small portion of heat exchangers 40 and 50, and as a result the fan will see relatively high pressures. This is an appropriate application for a fan with forward-swept tips. In accordance with the invention, the tips 46 of the fan blades 4 are shaped to maintain an approximately constant clearance with respect to the shroud barrel inlet 241.

Figure 5C:
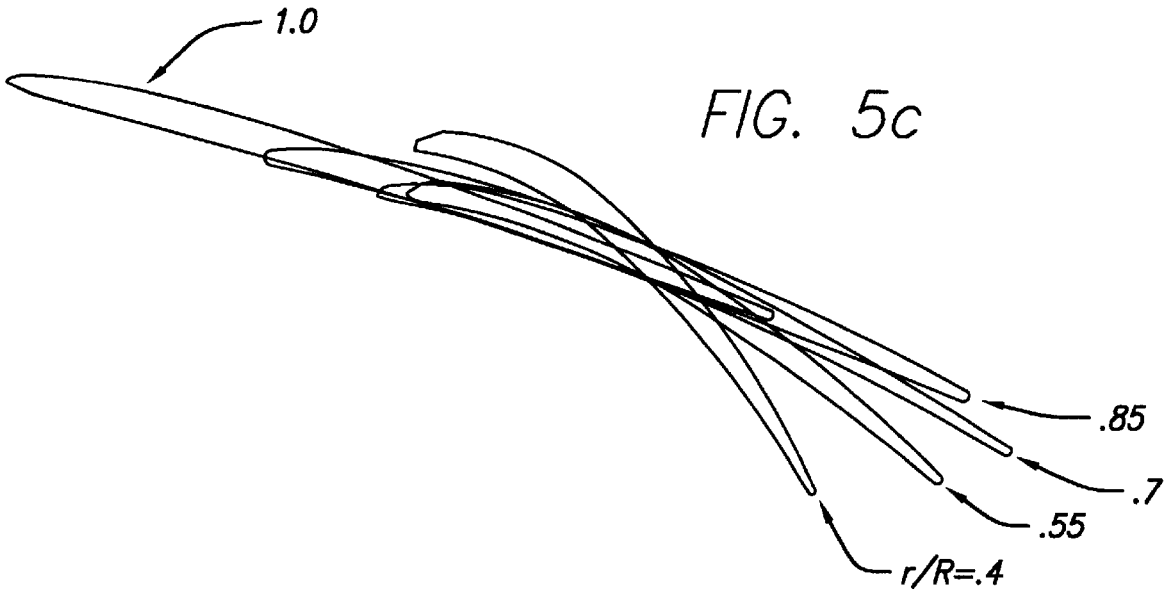

FIG. 5*c* shows several cylindrical sections of the fan shown in FIGS. 5*a* and 5*b,* the viewpoint being taken along the ray which passes through the mid-chord point 452 of the blade root 45, as shown in those figures. As in the case of the previous examples. the blade sections can be seen to be "stacked" as much as possible into a planar geometry.

Figure 6:
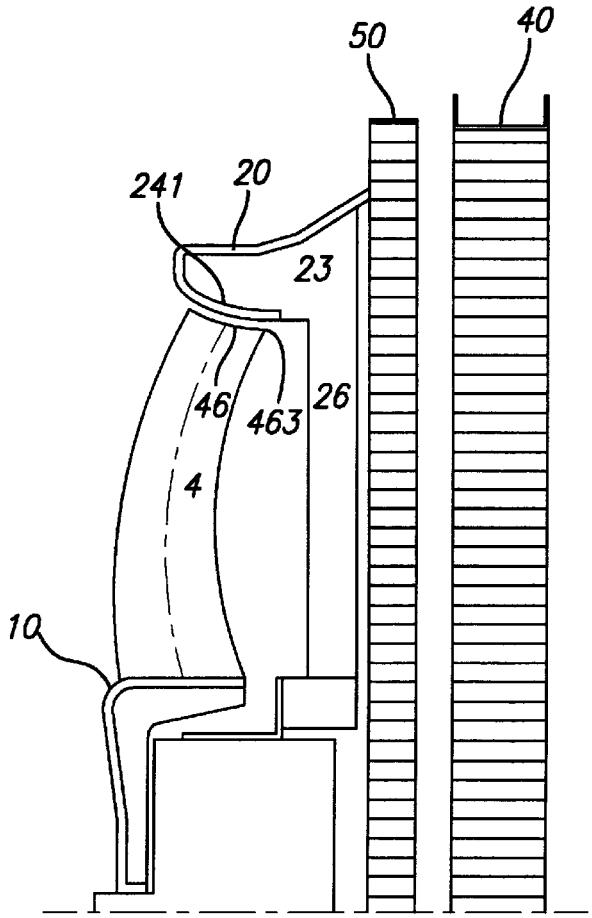
FIG. 6 is a sketch of a fan assembly in accordance with the present invention where the shroud is mounted upstream of the heat exchangers and the fan blades are forward-swept at the root and backward-swept at the tips.

FIG. 6 shows a section through a fan assembly where shroud 20 is mounted upstream of heat exchangers 40 and 50, and the fan 10 is that shown in FIGS. 4*a,* 4*b,* and 4*c*. In accordance with the invention, the tips 46 of the fan blades 4 are shaped to maintain an approximately constant clearance with respect to the shroud barrel inlet 241. The barrel 24 terminates a short distance downstream of the fan blade tip trailing edge 463. Stators 26 are supported by radial ribs 23. An advantage of this geometry is that shroud 20 can be injection-molded in a single piece with simple tooling.

Figure 7:
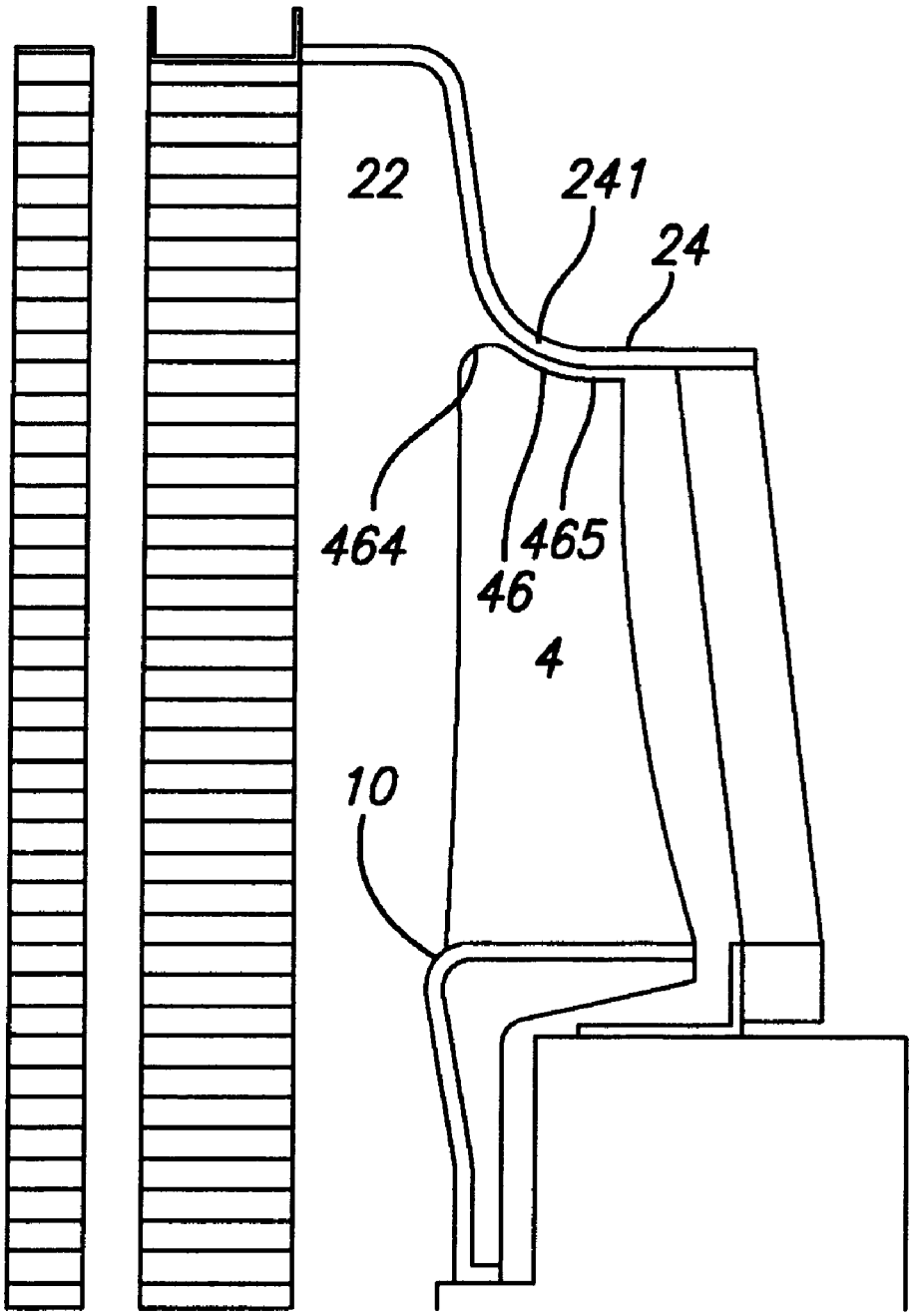
FIG. 7 is a sketch of a fan and shroud showing only the rearward portion of the fan blade tip conforming to the shroud shape.

FIG. 7 shows a section through a shroud and fan according to another embodiment of the present invention. The rearward portion 465 of the blade tip 46 conforms to the shape of the shroud barrel 24. The forward portion 464, however, does not conform to the shroud barrel 24, but instead allows a significantly larger clearance gap between the fan and shroud in this region. This configuration can be advantageous when packaging constraints severely limit the depth of the shroud. In such a case, a fan barrel which encloses the entire blade tip, as is shown in FIGS. 3*a* and 4*b,* can so deep that there is insufficient space available for the plenum 22. An insufficiently deep plenum will result in increased flow non-uniformity through the heat exchangers and an increase in required fan power. The configuration shown in FIG. 7 can be used to maintain a fan plenum of sufficient depth, at the expense of the small efficiency loss associated with increased leakage around a portion of the blade tip.

Figure 8:
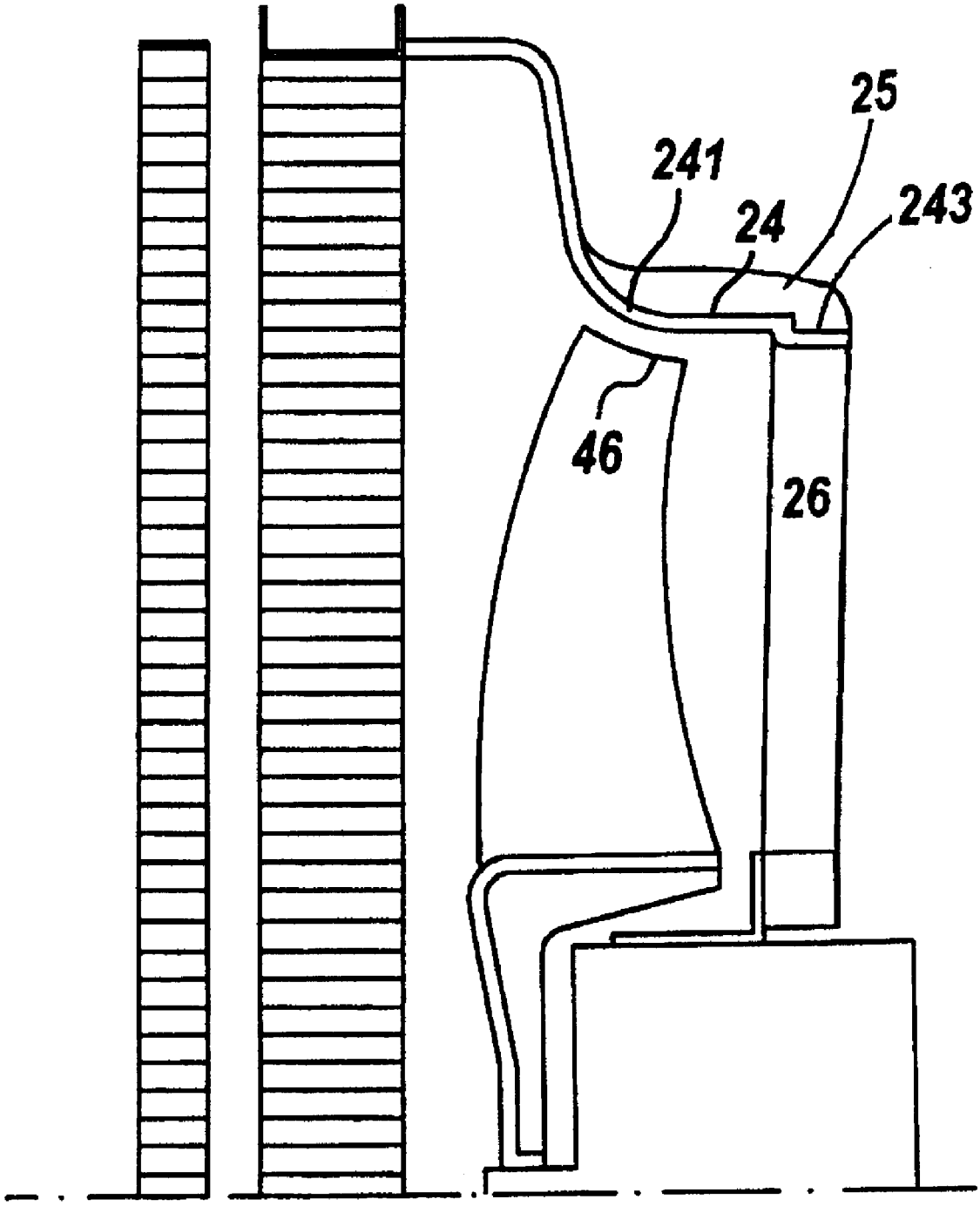
FIG. 8 shows a section through a shroud and fan according to another embodiment of the present invention.

FIG. 8 shows a section through a shroud and fan according to another embodiment of the present invention. Shroud barrel 24 comprises a stepped portion 243 downstream of the trailing edge of blade tip 46. Stators 26 are supported by this stepped portion, which in turn is supported by external shroud ribs 25. This configuration may reduce leakage flow through the clearance gap between the blade tip 46 and the shroud barrel 24. It has been found to have noise-reduction benefits in some applications where the system resistance is high.

Figure 9A:
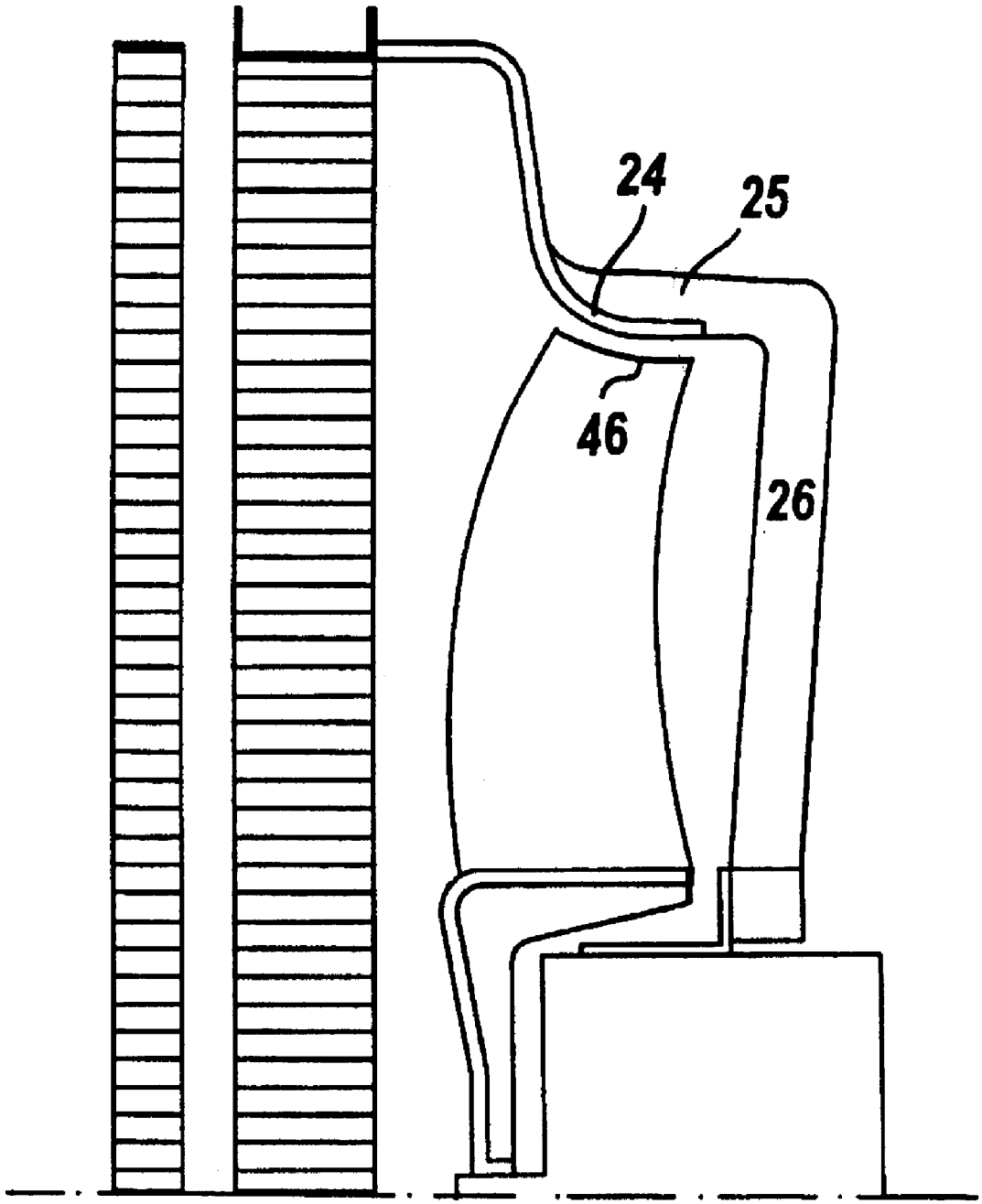
FIGS. 9*a* and 9*b* show sections through a shroud and fan according to two another embodiments of the present invention.
Figure 9B:
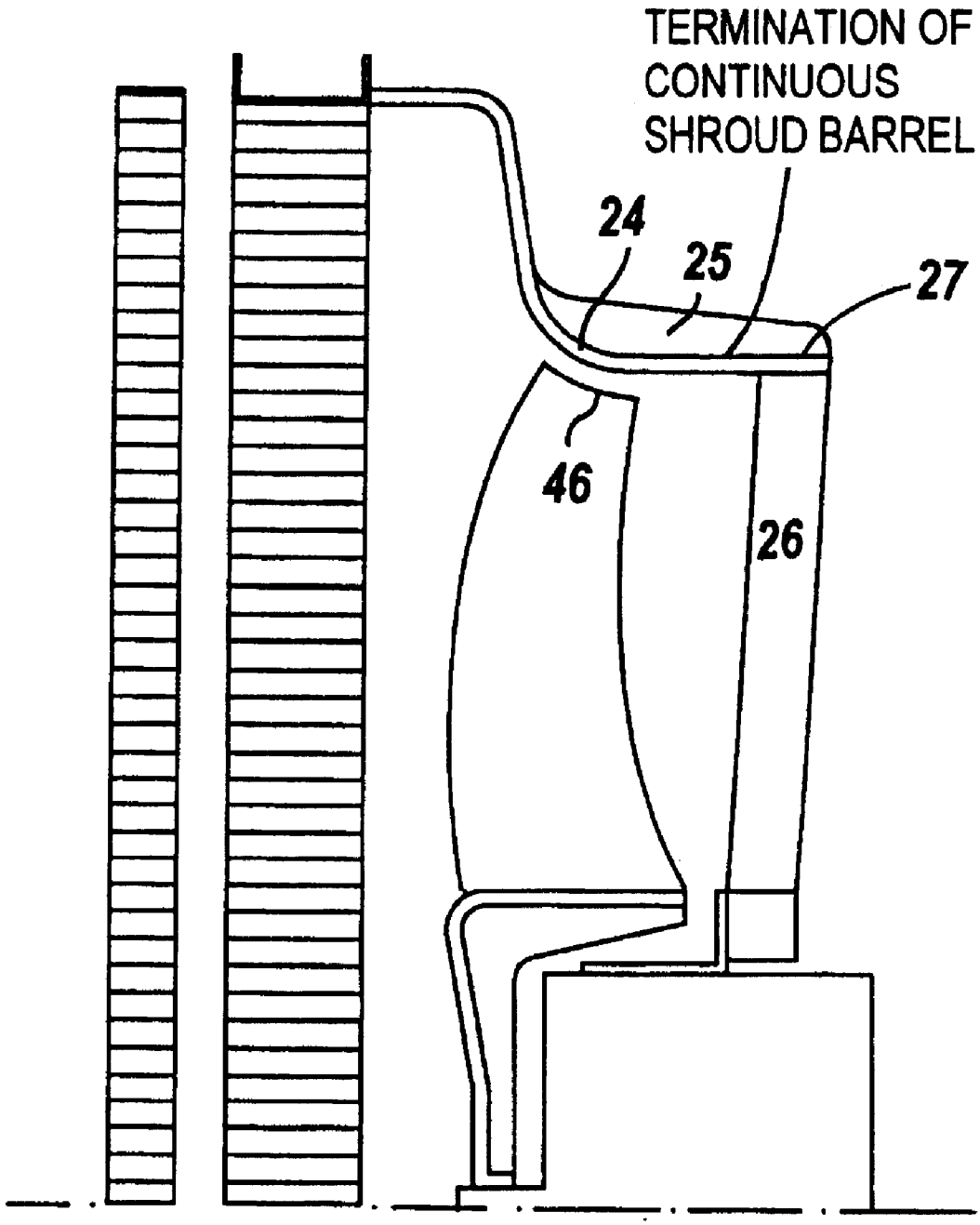

FIG. 9*a* shows a section through a shroud and fan according to another embodiment of the present invention. Shroud barrel 24 terminates within a small axial distance of the trailing edge of the fan blade tip 46. Stators 26 are extensions of external shroud ribs 25. This configuration has been found to have noise-reduction benefits when the system resistance is high. A further benefit is that of reducing the adverse effects of engine blockage. Another configuration which achieves these benefits is shown in FIG. 9*b*. Here the stators 26 are supported by local extensions of the shroud barrel 24, which are in turn supported by external ribs 25.

What is claimed is:

1. An automotive engine-cooling fan assembly comprising a shroud and a fan, said shroud comprising a barrel which surrounds said fan, and said fan comprising a central hub and a plurality of blades, each of said blades having a root portion and a tip portion, said tip portion having a leading edge and a trailing edge, said shroud being characterized in that the barrel comprises a flared inlet and said fan being characterized in that:

a) a portion of each blade tip is shaped to conform to the flared inlet of the shroud barrel;

b) the radius of the blade tip at the upstream end of the conforming portion is greater than the radius of the blade tip at the downstream end of the conforming portion;

said fan assembly being further characterized in that the shroud barrel comprises a stepped portion downstream of the blade tip trailing edge, and the radius of said stepped portion is less than that of the shroud barrel at the axial position of the blade tip trailing edge.

2. An automotive engine-cooling fan assembly comprising a shroud and a fan, said shroud comprising a barrel which surrounds said fan, and said fan comprising a central hub and a plurality of blades, each of said blades having a root portion and a tip portion, said tip portion having a leading edge and a trailing edge, said shroud being characterized in that the barrel comprises a flared inlet and said fan being characterized in that:

a) a portion of each blade tip is shaped to conform to the flared inlet of the shroud barrel b) the radius of the blade tip at the upstream end of the conforming portion is greater than the radius of the blade tip at the downstream end of the conforming portion;

said fan assembly being further characterized in that the fan blades are approximately radial when viewed from upstream and in that the fan blades are raked forward at the tips by less than approximately 3 percent of the fan diameter.

3. An automotive engine-cooling fan assembly comprising a shroud and a fan, said shroud comprising a barrel which surrounds said fan, and said fan comprising a central hub and a plurality of blades, each of said blades having a root portion and a tip portion, said tip portion having a leading edge and a trailing edge, said shroud being characterized in that the barrel comprises a flared inlet and said fan being characterized in that:

a) a portion of each blade tip is shaped to conform to the flared inlet of the shroud barrel;

b) the radius of the blade tip at the upstream end of the conforming portion is greater than the radius of the blade tip at the downstream end of the conforming portion;

said fan assembly being further characterized in that the fan blades are skewed.

4. The fan assembly of claim 3 further characterized in that the fan blades have a rearward rake angle in regions where they are back-swept more than approximately 15 degrees and a forward rake angle in regions where they are either back-swept less than approximately 5 degrees or forward-swept.

5. The fan assembly of claim 3 further characterized in that the fan blade is forward-swept at the root and back-swept at the tip, and has a forward rake angle at the root and a rearward rake angle at the tip.

6. The fan assembly of claim 3 further characterized in that the fan blade is back-swept at the root and forward-swept at the tip, and has a rearward rake angle at the root and a forward rake angle at the tip.

7. An automotive engine-cooling fan assembly comprising a shroud and a fan, said shroud comprising a barrel which surrounds said fan, and said fan comprising a central hub and a plurality of blades, each of said blades having a root portion and a tip portion, said tip portion having a leading edge and a trailing edge, said shroud being characterized in that the barrel comprises a flared inlet and said fan being characterized in that:

a) a portion of each blade tip is shaped to conform to the flared inlet of the shroud barrel b) the radius of the blade tip at the upstream end of the conforming portion is greater than the radius of the blade tip at the downstream end of the conforming portion;

said fan assembly being further characterized in that the distance between every point on the surface of the flared inlet and a corresponding point on an approximating ellipse is less than approximately 0.5 percent of the fan diameter.

8. The fan assembly of claim 7 further characterized in that one semi-axis of the approximating ellipse is axial and one semi-axis of the approximating ellipse is radial.

9. The fan assembly of claim 8 further characterized in that the radial semi-axis of the approximating ellipse is between approximately 0.4 and 1.0 times the axial semi-axis of that ellipse.

10. The fan assembly of claim 8 further characterized in that the axial semi-axis of the approximating ellipse is between approximately 0.5 and 2 times the axial extent of the blade tip.

11. The fan assembly of claim 8 further characterized in that the axial semi-axis of the approximating ellipse is between approximately 0.04 and 0.14 times the fan diameter.

12. The fan assembly of claim 8 further characterized in that the radial semi-axis of the approximating ellipse is between approximately 0.02 and 0.11 times the fan diameter.

13. The fan assembly of claim 7 further characterized in that the radial and axial coordinates of the conforming portion of the blade tips form a curve, and the distance between every point on that curve and a corresponding point on an approximating ellipse is less than approximately 0.5 percent of the fan diameter.

14. The fan assembly of claim 13 further characterized in that the ellipse approximating the shape of the flared inlet has a semi-axis which is axial and a semi-axis which is radial and the ellipse approximating the shape of the blade tip has a semi-axis which is axial and a semi-axis which is radial, and the axial semi-axis of the ellipse approximating the shape of the blade tip exceeds the axial semi-axis of the ellipse approximating the shape of the flared inlet by an amount equal to or greater than the amount by which the radial semi-axis of the ellipse approximating the shape of the blade tip exceeds the radial semi-axis of the ellipse approximating the shape of the flared inlet.

* * * * *